United States Patent [19]

Rector

[11] Patent Number: 4,790,787

[45] Date of Patent: Dec. 13, 1988

[54] BUBBLE MAKING SYSTEM HAVING RIGID BOW MEMBERS

[76] Inventor: Lloyd V. Rector, 17 Academy St., #2, Barre, Vt. 05641

[21] Appl. No.: 935,685

[22] Filed: Nov. 26, 1986

[51] Int. Cl.[4] ..... A63H 33/28; B62B 1/00

[52] U.S. Cl. ..... 446/15; 446/450; 446/487; 222/207; 280/47.26

[58] Field of Search ..... 446/15, 16, 17, 18, 446/19, 20, 119, 450, 487; 222/207; 280/47.26, 47.31, 47.33; 47/1.5

[56] References Cited

U.S. PATENT DOCUMENTS

| | | | |
|---|---|---|---|
| 910,728 | 1/1909 | Russell | 280/47.33 |
| 1,826,820 | 10/1931 | Perkins et al. | 280/47.33 |
| 2,606,395 | 8/1952 | Fulton | 446/15 |
| 2,744,735 | 5/1956 | Selvage | 280/47.31 |
| 2,850,289 | 9/1958 | Grube | 280/47.31 |
| 2,928,205 | 3/1960 | Fulton | 446/15 |
| 3,826,511 | 7/1974 | Frank | 280/47.31 |
| 4,261,596 | 4/1981 | Douglas | 208/47.33 |
| 4,362,309 | 12/1982 | Stamper | 280/47.33 |
| 4,570,961 | 2/1986 | Chateauneut et al. | 280/47.33 |
| 4,654,017 | 3/1987 | Stein | 446/15 |

FOREIGN PATENT DOCUMENTS

| | | | |
|---|---|---|---|
| 253064 | 2/1964 | Australia | 280/47.31 |
| 618422 | 4/1961 | Canada | 280/47.31 |
| 2460146 | 2/1981 | France | 446/15 |
| 1429521 | 3/1976 | United Kingdom | 280/47.31 |

OTHER PUBLICATIONS

Zubrowski, Bernie; "Bubbles", pp. 18 & 19, 1979.
Advertisement for "Bubble Hoop TM", Bubble Maker, p. 181 of the Nov. 1986 issue of Parent's Magazine.
Instructions for "Bubble-Thing TM", Bubble Maker by David Stein Incorporated, New York, New York.

*Primary Examiner*—Robert A. Hafer
*Assistant Examiner*—Charles H. Harris
*Attorney, Agent, or Firm*—Timothy J. Martin; J. Preston Oxenham

[57] ABSTRACT

A preferred embodiment of a bubble making system for making large bubbles comprises a pallet for holding bubble-making fluid and a bubble maker with a plurality of user controlled bow members. The bow members are pivotally attached to each other at upper ends and lower ends and having protruding hand grips at the lower ends on their concave sides. Each bow member may include a supply system to wick and hold a supply of bubble-making fluid.

In operation, a user draws the bow members through bubble-making fluid held by the pallet to fill the supply system. Then, while waving the bows through the air or projecting the bows into the wind, the user pivots the bow members with the hand grips to produce a variable sized opening between the bows to form a bubble between the bows. The bubble can then be set free by twisting the hand grips in the opposite direction, causing the bows to close and contact each other.

20 Claims, 9 Drawing Sheets

FIG. 18
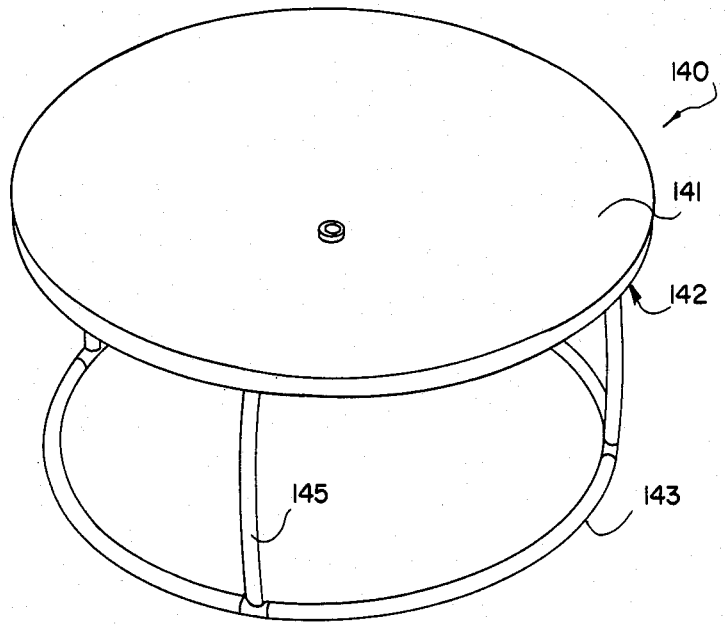
FIG. 19
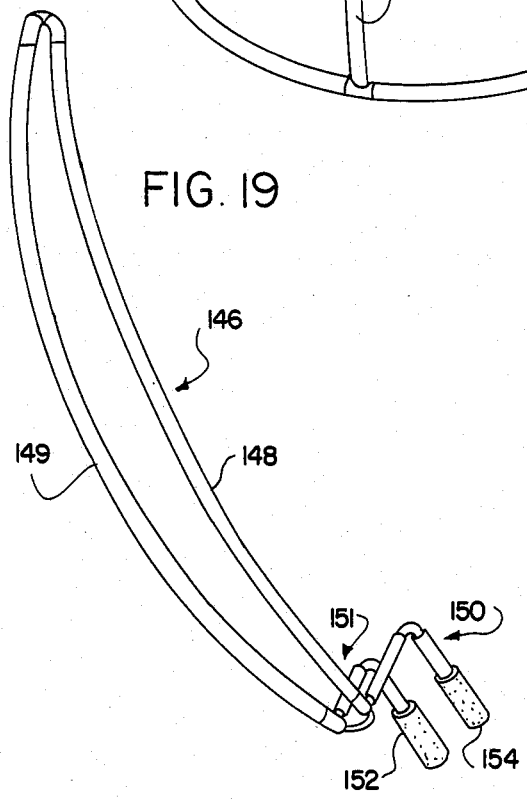
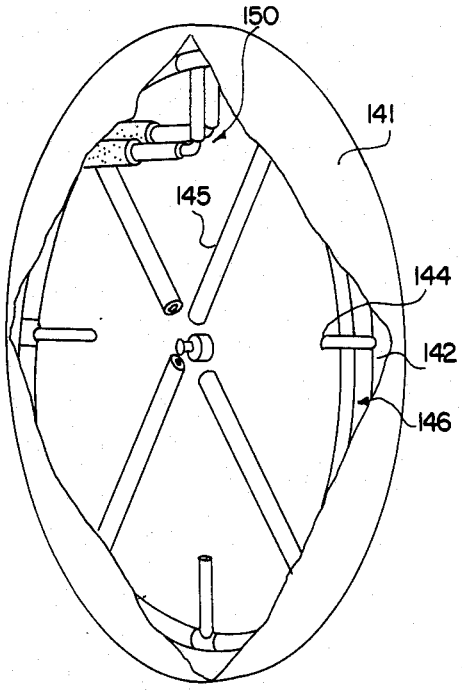
FIG. 20

BUBBLE MAKING SYSTEM HAVING RIGID BOW MEMBERS

BACKGROUND OF THE INVENTION

The present invention relates to devices for making bubbles and, more particularly, to devices for making bubbles for entertainment purposes.

Devices for making bubbles from thin films of soapy fluids have been popular for a long time, especially for entertaining children or others at parties, parades or other festive occasions.

To make bubbles, most prior art bubble making systems begin with the submersion and extraction of a rigid loop in a reservoir or container of highly viscous fluid. Then, air is blown through the loop, or the loop is waved through the air, to create a stream of bubbles.

One prior art design (marketed under the trademark BUBBLE-THING TM by David Stein Incorporated, New York, N.Y.) utilizes a flexible strip of absorbent material or fabric rather than a rigid loop. Both ends of the strip are attached to a short rod, with one end of the strip fixed and the other end slidable along the rod. To operate this device, a user first saturates the fabric with "magic" fluid, keeping the fabric's slidable end immediately adjacent to its fixed end. Then, holding the rod out with the material hanging down, the user slides the movable end away from the fixed end, allowing air to flow through the V-shaped, film covered opening, to create bubbles.

Both rigid-loop and sliding-fabric type devices of the prior art have inherent practical limitations which constrain the size of the bubbles which may be created. As the diameter of rigid loops is increased, the size of the fluid container must also be increased. Also, as loop diameter is increased, it becomes more difficult to maintain a cohesive fluid film across the loop to expose to a current of air.

The size bubble which can be created by a sliding fabric device is limited by the height of the user because the bottom of the V-shaped opening of the fabric can hang no lower than the surface upon which the operator is standing. The shorter the operator, the smaller the bubble. Additionally, such prior art devices cannot readily be extended above or away from the user to catch the wind. They cannot readily be whipped or undulated through the air and, consequently, they are quite dependent on prevailing wind conditions for their effectiveness.

It is the primary object of the present invention to provide an improved bubble making system, and, in particular, to provide a system which can make very large bubbles for the entertainment of children or others at parties, parades and other festive occasions.

Another object of the bubble making system of the present invention is to provide a bubble maker which is readily extendible to above or away from the operator to reach into a wind, or to be undulated or whipped by the user, to make bubbles.

Another object of the present invention is to provide a bubble making system which is light and easy to use and can be used safely and effectively by small children.

It is a further object to provide a bubble making device which is collapsible and, thus, easily portable.

It is still a further object to provide a bubble making system which may be fabricated of uncomplicated, common components so the device is easy and inexpensive to manufacture.

The above and additional objects of this invention will become more apparent when the following description is read in conjunction with the accompanying drawings.

SUMMARY OF THE INVENTION

The preferred embodiment of the bubble making system of the present invention comprises a pallet for holding bubble making fluid and a bubble maker for forming bubbles. The bubble maker of the present invention comprises two arcuately shaped bows pivotally connected to one another at their ends. Each has a hand grip protruding near its lower end. Each bow section is hollow and contains a fluid supply system. To make bubbles, a user draws the bubble maker, in a close position, through the fluid on the pallet. Then, he or she twists the hand grips to cause the middle sections of the bows to pivot away from one another and form a closed, generally lenticular shape while extending the bubble maker into the wind or moving it through the air.

As the bows separate, a film, drawn from the fluid supply systems within the bows develops between them. After the moving air causes the film to form a bubble shape, the operator twists the hand grips in the opposite direction to cause the bows to close and contact each other to form and set free a bubble.

The size of the bubble is determined by the width of the opening created by the twisting of the hand grips. When the supply of fluid in the fluid supply system is exhausted, the operator again draws the closed bows through the fluid on the pallet to continue making bubbles.

BRIEF DESCRIPTION OF THE DRAWINGS

FIG. 18 is a perspective view of a circular pallet in its ready-for-use mode;

FIG. 19 is a perspective view of a bubble maker embodiment, comprising modified bows, to be used with the circular pallet of FIG. 18; and, FIG. 20 is a perspective view of the circular pallet in its collapsed, portable mode with the bubble maker of FIG. 19 stored within the pallet.

DETAILED DESCRIPTION OF THE PREFERRED EMBODIMENTS

Figure 1:
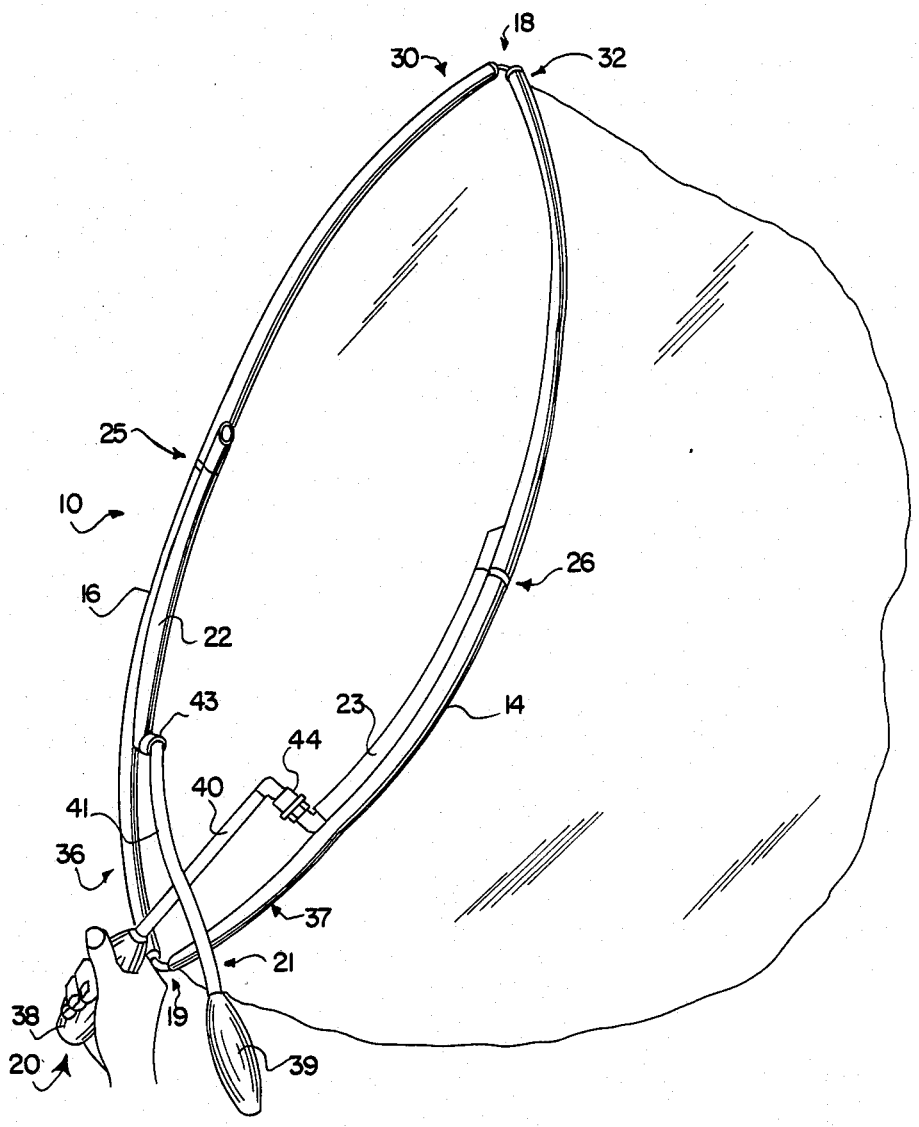
FIG. 1 is a perspective view of a bubble maker constructed in accordance with the present invention, wherein the device is in an open position, showing a bubble being formed.
Figure 10:
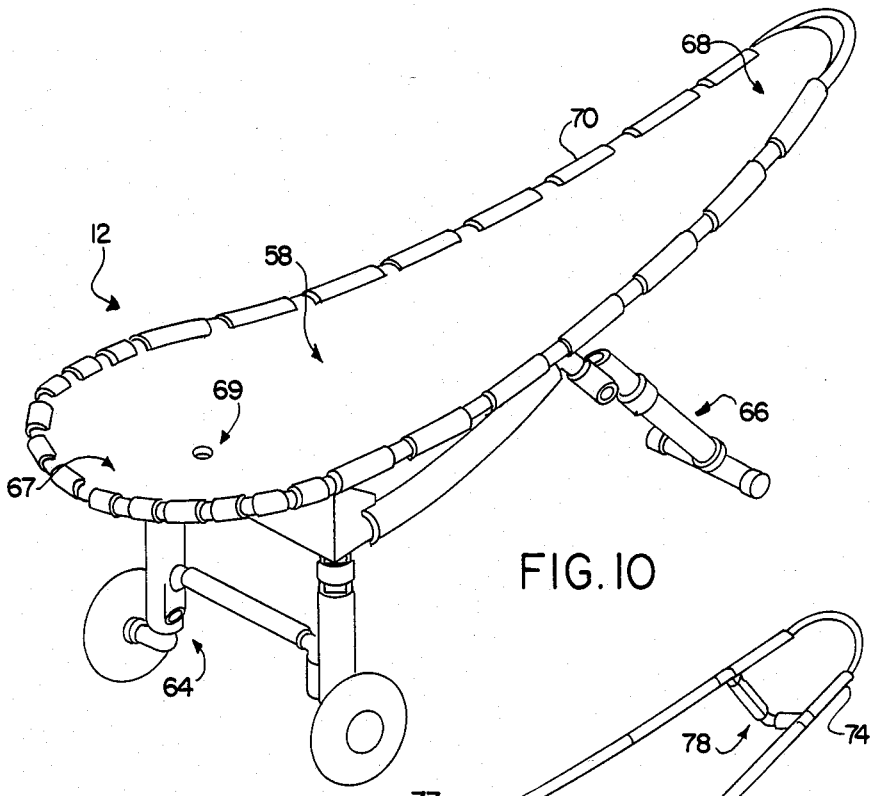
FIG. 10 is a perspective view of a pallet to be used with either of the bubble maker embodiments shown in FIGS. 1–7 or FIGS. 8–9.

The preferred embodiment of the bubble making system of the present invention comprises two principal components, a bubble maker 10, shown in FIG. 1, and a pallet 12, for holding bubble making fluid, shown in FIG. 10.

Figure 4:
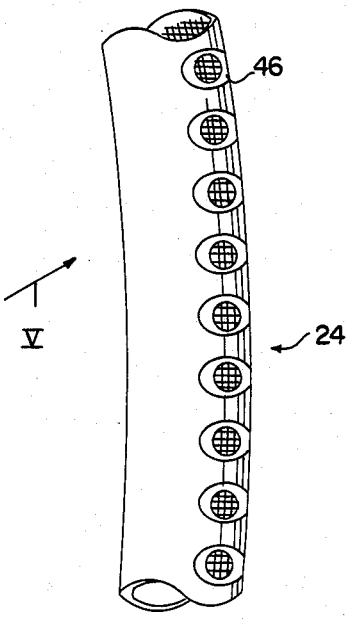
FIG. 4 is a bottom view of an enlarged portion of the bows, showing the holes and screen of a supply system.

The bubble maker 10 of the present invention consists of two arcuate bows, as seen from the view of the operator, a right bow 14 and a left bow 16. Bows 14 and 16 are connected to each other at their ends by hinges 18 and 19. Hand grips 20 and 21 protrude from the concave side of the arcuate bows 14 and 16 at their lower ends. Hand grips 20, 21 are attached to reinforcement tubes 22 and 23. Each bow, 14 and 16, is hollow and houses a fluid supply system, 24, as shown in FIG. 4.

Figure 2:
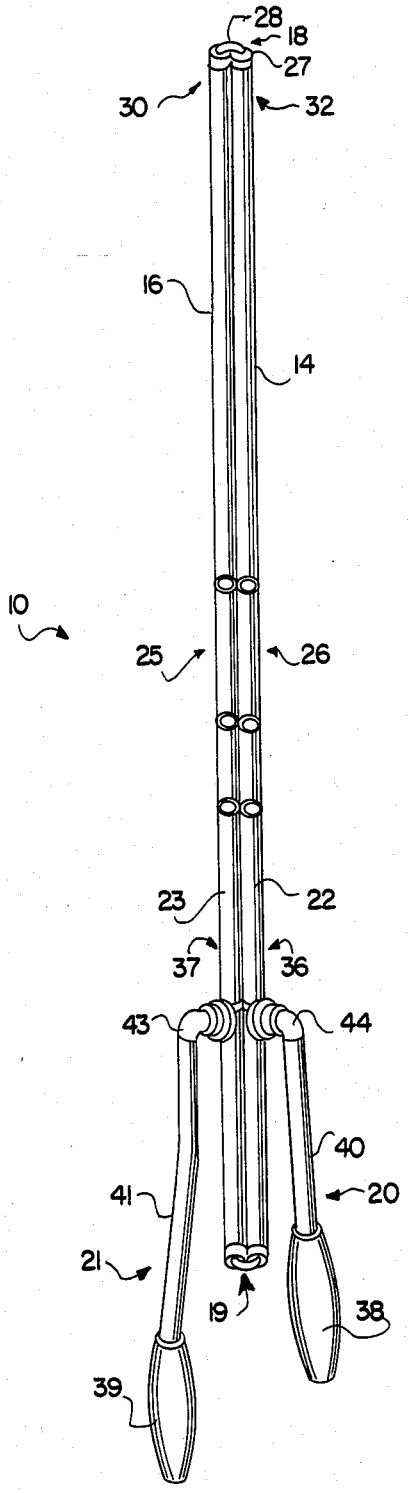
FIG. 2 is a top plan view of a bubble maker comprising the present invention showing two arcuate bow members in a closed position.

Bows 14 and 16 are preferably made from hollow, elastic tubes, such as, for example, commercially available indoor plumbing pipe of acrylonitrile butadiene styrene (A.B.S.) resin. As best shown in FIG. 2, the midsection of each bow has a separation joint 25, 26 which allows breakdown of the bow for portability or insertion of an extension.

Figure 7:
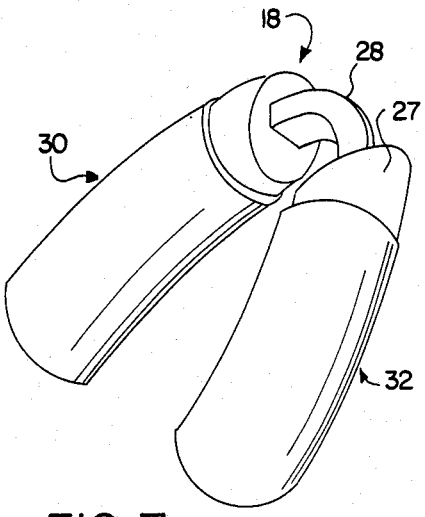
FIG. 7 is an enlarged view of the hinge shown in the upper portion of FIG. 1.

Referring to FIG. 1, adjacent ends of bows, 14 and 16, are connected by identical hinges 18, 19 at the bottom and top of the bows. Hinges 18, 19 are shown in detail in FIG. 7 and may be made, for example, from commercially available plumbing elbows of appropriate diameter fabricated of A.B.S. resin. The elbow is cut perpendicular to its axis at the mid-point of its 90 degree turn. A short tube 28 of flexible material, for example, rubber, is then inserted into each half of the elbow to rejoin them. The uncut end of each elbow half is then inserted into the upper bow portions 30, 32 and secured by set screws (not shown).

Figure 3:
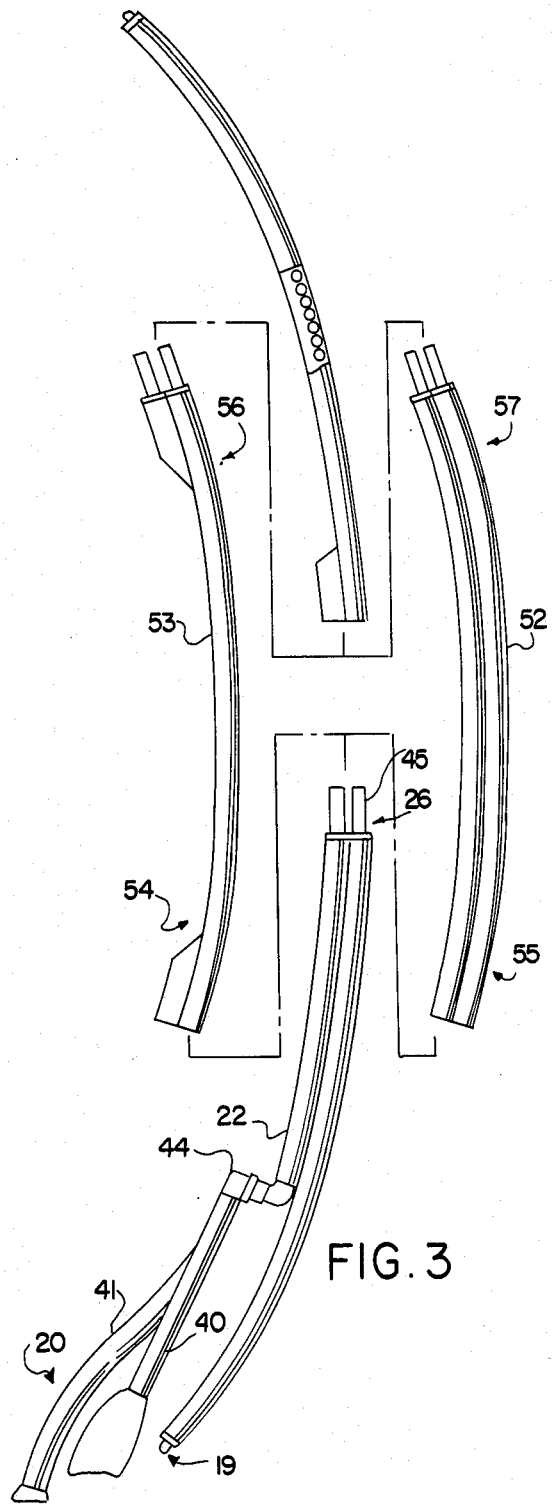
FIG. 3 is a partially exploded side view of the bows of FIG. 2, showing two extension inserts and the locations at which the extensions are inserted.

Hand grip members 20, 21 comprising tubes 40, 41 and hand grips 38, 39 protrude from the bottom portions 36, 37 of the bows, as shown in FIGS. 1, 2 and 3. Hand grip members may be made, for example, of tubes of A.B.S. resin piping. The hand grip portions 38 and 39 of hand grip members 20, 21 may be made of commonly available children's bicycle handlebar grips, for example. Tubes 40 and 41 can enclose rods made of rigid material, for example, copper or aluminum, to increase their rigidity.

In the embodiment of FIG. 1, each tube 40, 41 includes a double elbow 43, 44, respectively, so that the hand grips are outwardly spaced from bows 14 and 16, and extend downward along the bows. One hand grip member, member 41 in the case of the embodiment of FIG. 1, is longer and extends further outward from the bow 16 than the other, right hand grip tube 40 in the illustrated embodiment, to allow the user's left hand to pass over the right when opening the bows, 14, 16.

The double elbows 44 extend into the structural reinforcement tubes 22, 23, as shown in FIG. 3. Reinforcement tubes 22 may be made, for example, of A.B.S. resin. Tubes 22, 23 are affixed, for example, by welding, to the concave side of the bows, 14 and 16. Alternatively, the reinforcement tubes could be integrated and fabricated along with the bows. The reinforcement tubes 22, 23 serve to prevent rolling of the bows 14 and 16 and increase the structural rigidity of the bubble maker. The tubes 22, 23 extend along bows 14 and 16 only so far as is necessary to add sufficient structural rigidity for satisfactory operation.

Bows 14 and 16, together with tubes 22, 23, are separable at separation joints 25, 26. In the exemplary embodiment, these joints comprise couplings 45 in each of the bows 14, 16 and the reinforcement tubes 22, 23. Separation joints 25, 26 allow enlargement of the bubble maker 10 by insertion extension inserts 52 or 53, shown in FIG. 3. The separation joints 25, 26 of each bow may be taken apart and the coupling at the lower half of each bow 14, 16 inserted into the lower ends 54, 55 of the extension inserts. The upper ends 56, 57 of the inserts of the preferred embodiment contain resin male couplings 45 and are inserted into the upper halves of the bows 14 and 16. Additional extension inserts may be used to extend the bows to any appropriate length desired. Extension inserts 52, 53 are preferably the same diameter as the bows 14, 16.

Figure 5:
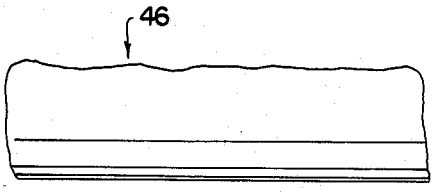
FIG. 5 is a fragmentary view of the bow portion of FIG. 4, as seen in the direction of arrow V, showing holes of the supply system.
Figure 6:
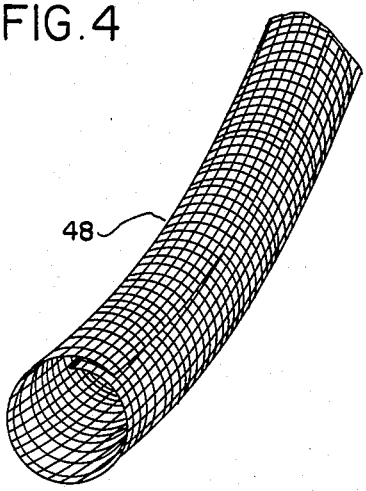
FIG. 6 is a view of an enlarged portion of a rolled screen of the supply system.

Bows 14 and 16 may be hollow and include a bubble making fluid supply system 24 as shown in FIGS. 4–6. As best shown in FIG. 4, the feed system 24 includes holes 46 at regular intervals along bows, 14 and 16. In the right bow 14 the holes 46 are in a row on its left and, on the left bow 16 the holes are on its right. Thus holes 46 of bows 14, 16 generally oppose each other when the bubble maker 10 is in a closed position.

As best shown in FIG. 6, a screen mesh sleeve 48 lies within each of hollow bows 14 and 16 and is approximately the same diameter as the inner diameter of the bows. This allows the screen sleeve 48 to closely underlie the holes 46 so that, when the bubble maker 10 is passed through bubble making fluid, fluid adheres to the screen.

During the making of a bubble, fluid that adheres to the exterior of the bows 14 and 16 starts the bubble. Then, additional fluid picked up from the pallet by a "wick effect" and held within the bows, is drawn back through the holes 46 from the screen sleeve 48. Extension inserts 52, 53 may utilize similar supply systems.

Figure 11:
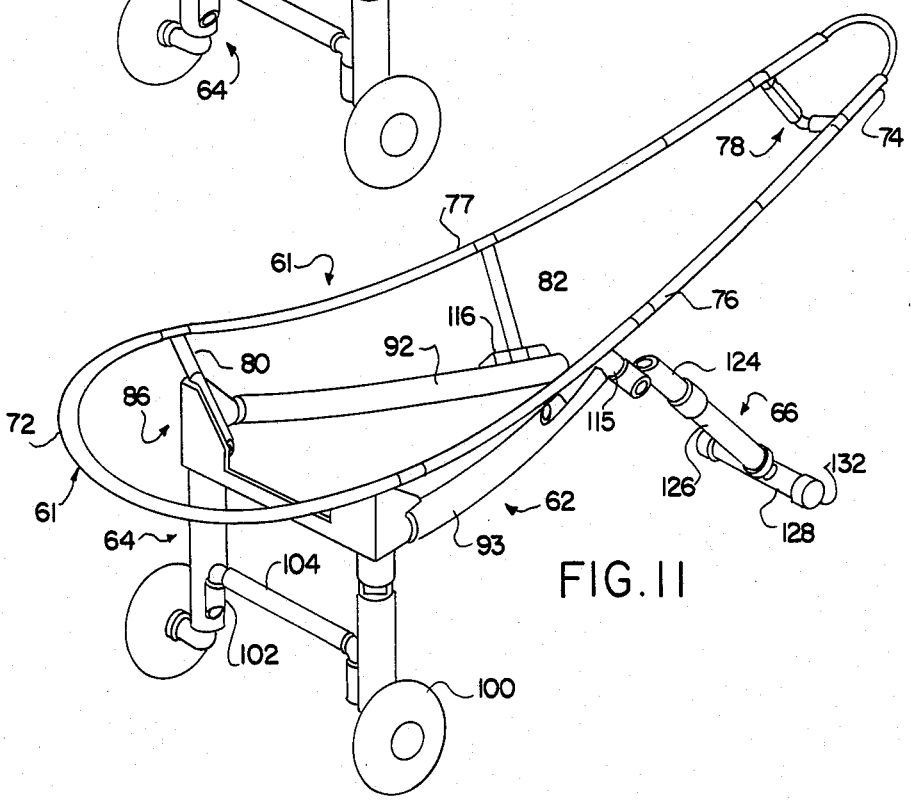
FIG. 11 is a perspective view of the pallet with its liner removed, showing a pallet frame including a lip support for the liner and an underlying chassis.
Figure 12:
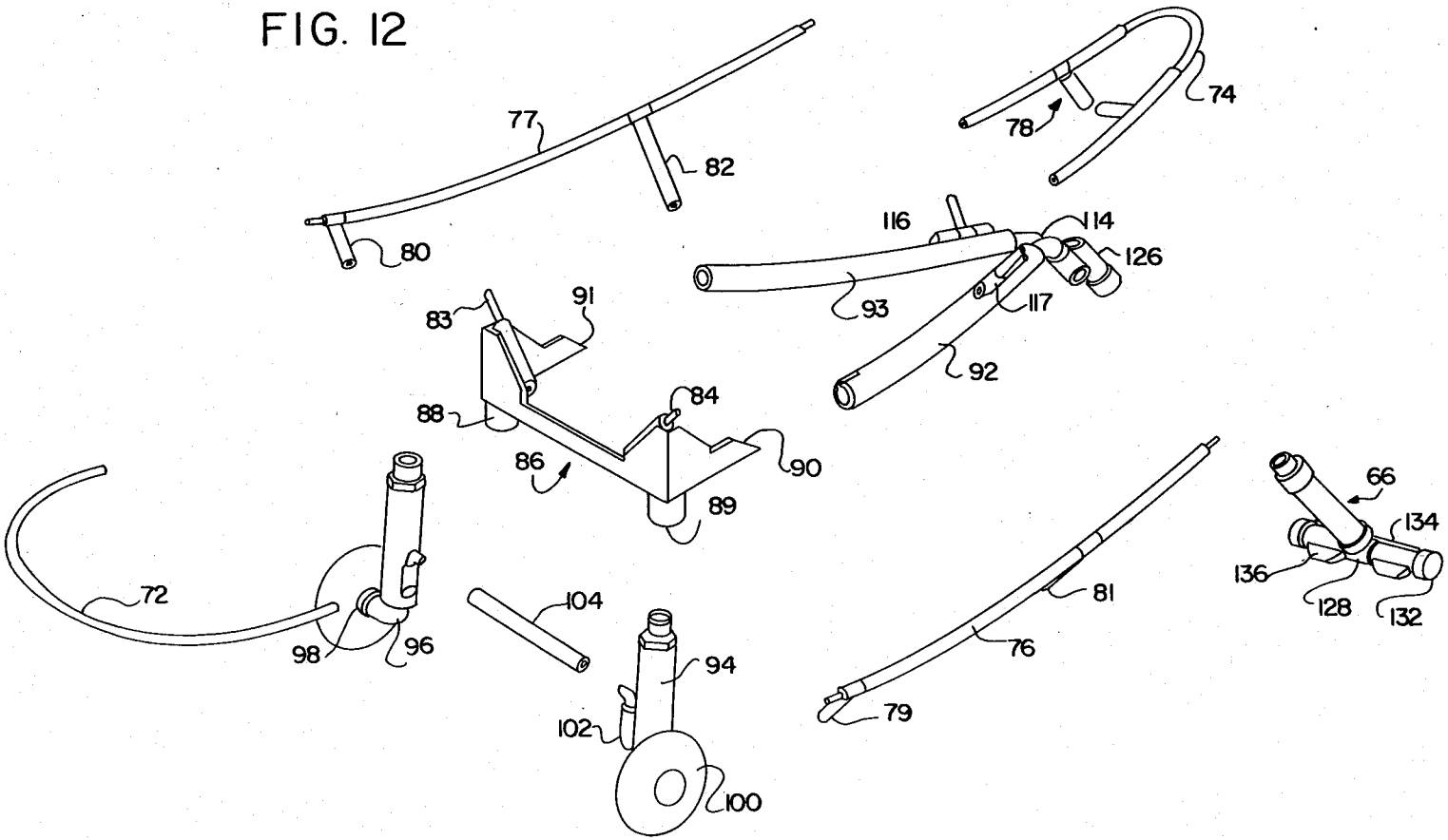
FIG. 12 is an exploded, perspective view of a pallet frame.

FIGS. 10–12 show a second component of the present invention. A pallet for holding bubble making fluid, 12 comprises an impermeable membrane, 58, surrounded and supported by a lip support, 61. The lip support is supported at four points above chassis 62 by connecting members 79, 80, 81, 82. The chassis has two forward ground contacting legs 64, each with wheels, 100, and a single, rearward support footing 66. Liner 58 is pipe-holer shaped with a wider, forward end 67 lower than the narrow, rearward end 68. In the middle of the forward end, at the low point of the liner 58, is a drain plug 69. When bubble making fluid is poured upon the pallet, it pools at this low point. A user draws the bubble maker 10 through the pool toward the narrow, upper end 68 so that drippings of excess fluid pour onto the narrow end and flow downward, back to the pool.

As best shown in FIGS. 11 and 12, the lip support 61 surrounds the liner 58. The liner 58 is clamped to the lip support 61 by clamps 70. These clamps may be, for example, nothing more than short sections of A.B.S. resin pipe of the same diameter as lip support 60 with slit walls so that they can be forced to slide over the lip support tube 61 to clamp the edge of the plastic liner between the clamp and the tube. The wide, forward end 67 of the liner is doubled over to form a pocket which slides over the corresponding forward end 72 of the lip support 61.

Referring to FIG. 12, lip support 61 is made of four sections which are detachable for easy portability. These are a forward arcuate end 72, rear arcuate end 74, and two side sections 76 and 77. Both ends of the side sections 76, 77 have couplings which couple with forward and rear sections 72, 74 to hold lip support 61 together. Lip support, 61, may be made, for example, of hollow tube, such as A.B.S. resin plumbing pipe.

Cross member support 78 maintains alignment of rear arcuate end 74. Cross member 78 may be fabricated, for example, of two standard tee inserts with short pipe sections extending from each tee and joined by a standard A.B.S. resin elbow. Because the cross member 78 extends downward between the two sides, the gradual slope of the plastic liner 58 is not interrupted by the cross member and drippings can flow downward to the actual low point of the liner 58.

Four members connect lip support 61 and chassis 62. In the preferred embodiment, these four connecting members consist of four standard tee inserts, two in each of the two side sections 76, 77 of the lip support. Connecting members 79, 80 are shorter than rear connecting members 81, 82 to provide the desired slope of the lip support 61. The forward two connecting members 80, 81 extend downward and are inserted on standard A.B.S. resin couplings 83, 84 which protrude from forward chassis portion 86.

Figure 13:
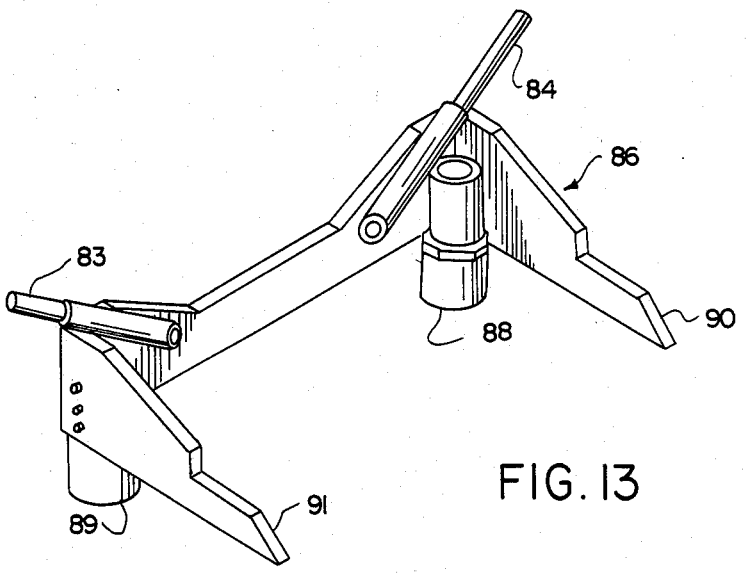
FIG. 13 is a perspective view of a "milk crate" portion of the FIG. 11 chassis.

As seen in FIG. 13, forward chassis 86 of the preferred embodiment may be made of a half of a common plastic milk crate and supports three pair of structural projections; members 79, 80, connected to chassis portion 86 by couplings 83, 84; legs 94, connected by couplings 88, 89; and main chassis tubes 92, 93 running rearward connected by projections 90, 91.

Figure 14:
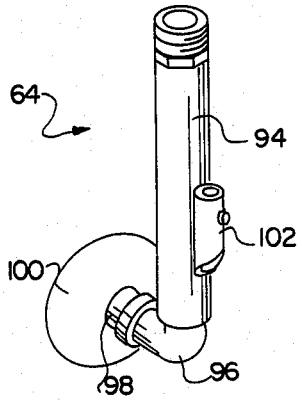
FIG. 14 is a perspective view of a forward leg of the pallet shown in FIGS. 10 and 11.

Referring to FIG. 14, legs 64 support the pallet 12, and wheels 100 allow a user to raise the rear end of the lip support 74 and push or drag the pallet, much like a wheel barrow, for easy transport.

In the preferred embodiment, legs 64, are formed of vertical tubes 94 with male threaded upper ends which screw into female threaded inserts 88, 89 in the forward chassis portion 86. The bottom of tube 94 encloses elbow 96 which is held in place by set screws. A wheel 100, for example, a model airplane wheel, is bolted to elbow 96. Cross member 104 is affixed to cross member braces 102 to extend between and keep the legs 94 properly aligned.

Figure 15:
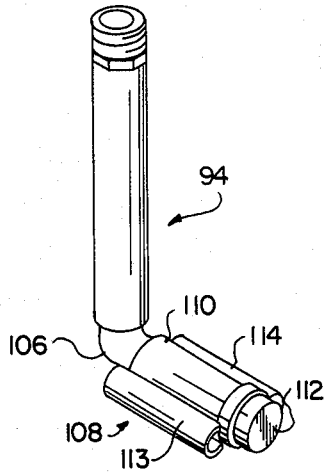
FIG. 15 is a perspective view of an alternate leg comprising stationary footing.

FIG. 15 shows an alternative embodiment which eliminates wheels 100. A larger diameter pipe sleeve 110 slides on foot 106 on the base of leg 94 and is rotatably held in place by end cap 112. Pipes 113, 114 are welded to sleeve 110 to provide a wider and stronger contact area with the ground. Pipes 113, 114 are integral with sleeve 110 and rotate about the foot 108 to accommodate an uneven surface.

Figure 16:
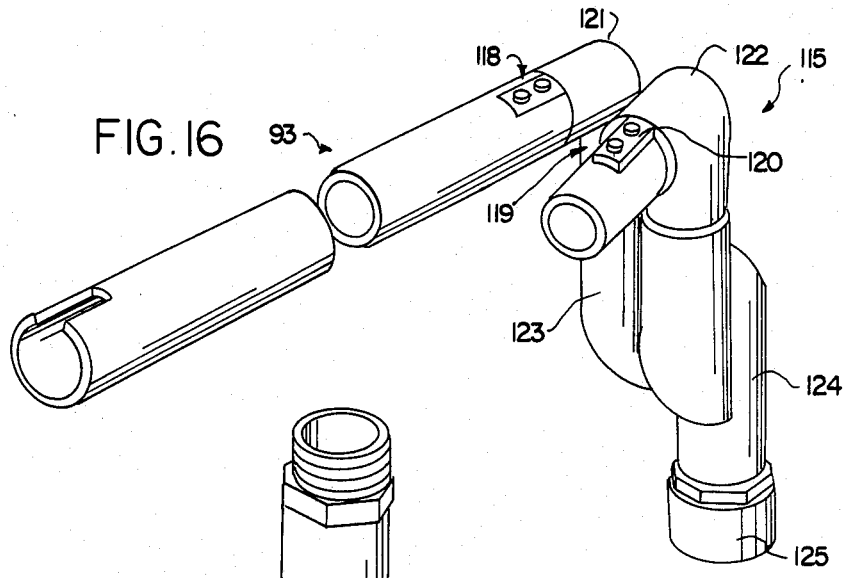
FIG. 16 is a perspective view of a Y-joint of a portion of the pallet chassis.

The beveled edges 90, 91 of the forward chassis portion 86 protrude into and support the main chassis tubes 92 and 93, as shown in FIG. 12. Main chassis tubes 92, 93 form an "A" configuration and meet at the Y-joint 115 of the chassis. Two tees 116, 117 made of smaller diameter tubes, are welded onto the main chassis tubes 92 and 93. The upward projection of each tee 117, 116 receives a rear connecting member 81, 82, respectively, of the lip support 61. FIG. 16 shows that the chassis tubes 92, 93, maintain their proper alignment by means of a slot locks 118, 119 at both their ends. These locks prevent rolling of either tube.

As shown in FIG. 16, the Y-joint 115 receives the rear ends of the main chassis tubes 92, 93 in two elbows 121, 122 which contain receiving blocks 120 of the slot locks 118, 119. The other end of the two make elbows 121, 122 project downward into a figure eight housing 123. This housing is made of two short sections of pipe welded together side by side. The figure eight housing 123 is, in turn, welded to a short section of pipe 124 along the seam of the figure eight. This center post 124 of the Y-joint 115 extends downward, below the figure eight housing, and ends with a female threaded coupling 125 for receiving the rear support footing 66.

Figure 17:
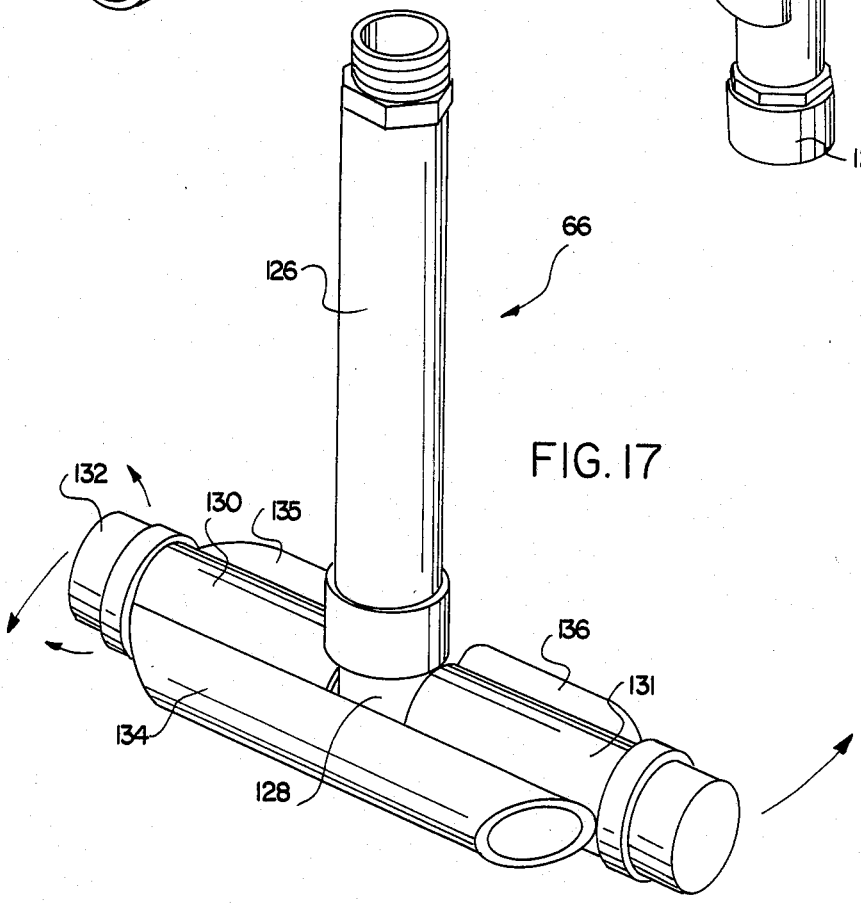
FIG. 17 is a perspective view of the rear ground support footing of the pallet of FIGS. 10 and 11.

As best shown in FIG. 17, the rear support footing 66 includes a standard threaded male coupling that screws into the coupling of Y-joint 115. Tube 126 extends downward to the central strut of a tee. The cross piece of tee 128, fits within larger diameter sleeves 130, 131 and is retained by caps 132 which allow the sleeves 131, 132 to swivel. Smaller diameter cross pipe 134 is welded to sleeves 130, 131, but does not contact the underlying tee. On the opposite side of the sleeves 130, 131, two short reinforcement sections 136, 135 are welded. Cross pipe 134 and reinforcement sections 136, 135 distribute the weight the footing supports to a large surface area, and add structural strength to the footing. The vertical portion of rear support tee 128 is of such a diameter that it swivels in a coupling of 126.

The center post of the Y-joint 124 and rear support tube 126 extend downward at an angle in the direction of the rear of the pallet, and not at 90 degrees to the ground or support surface. Therefore, because the tee at the bottom of the support post 126 can swivel, the rear support footing 66 will align to the ground plane below the pallet 12 and distribute the system's weight evenly upon any plane beneath the pallet 12.

Figure 8:
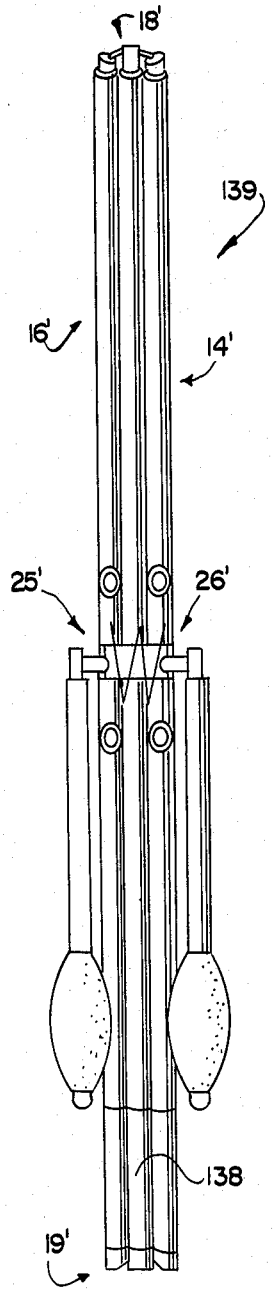
FIG. 8 is a top plan view of a second embodiment of the present invention in its closed position.
Figure 9:
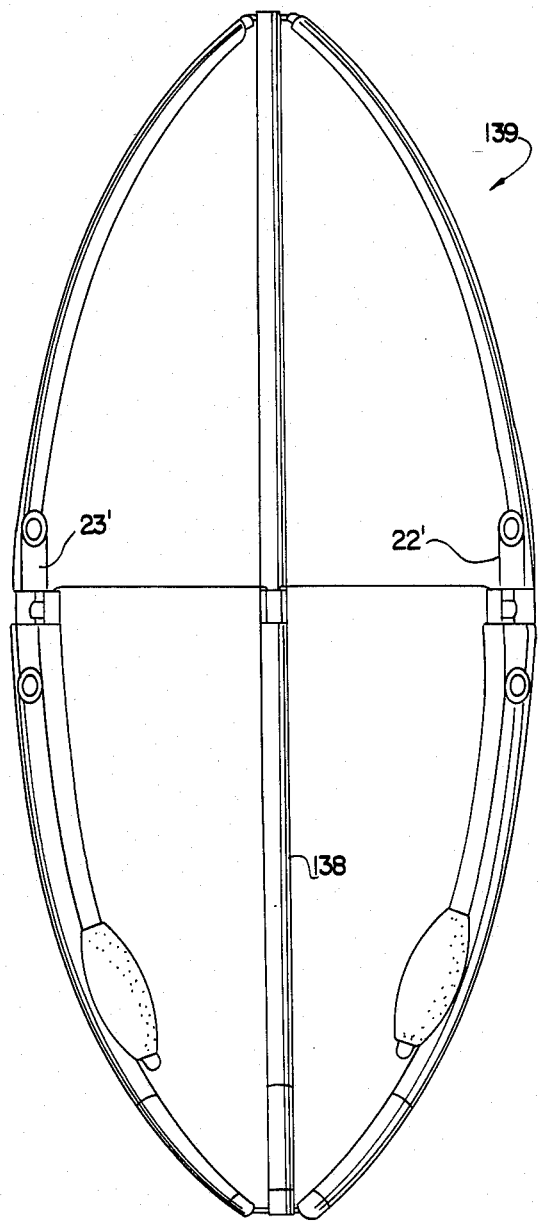
FIG. 9 is another top plan view of the embodiment of FIG. 8, but in an open position.

A second embodiment of the bubble maker is shown in FIGS. 8 and 9. The bubble maker of FIGS. 8 and 9 includes components which are identical to those of the bubble maker shown in FIGS. 1–7 and which are designated in FIGS. 8 and 9 with the same numerals primed. Bows 14' and 16' are pivotally connected to, and pivot away from, a center tube 138 to form a bubble maker structure 139. The bubble maker of the second embodiment produces bubbles which have more complex and unusual forms than those provided by the first embodiment.

A third embodiment of the bubble making system is shown in FIGS. 18–20. In this embodiment, both the bubble maker and pallet are scaled down. This embodiment is more portable and easy to manufacture than the bubble maker and pallet shown in FIGS. 1–17.

FIG. 18 shows a smaller circular pallet 140 which is surrounded and covered on its top by a pocket-like fluid containing liner 141. The frame of this pallet is simply two separate collapsible rings 142, 143 that are interconnected by upper and low sets of rotatable tees 144, 145.

Tees 144 on upper ring 142 insert into the receiving ends of tees 145 on lower ring 143.

As shown in FIG. 19, a small bubble maker 146 consists of two bows 148, 149 pivotally connected, but without the previously described supply system 24, the separation joints 25, 26 and the reinforcement tube 22. Additionally the small unit bubble maker 146 has simple hand grips 150, 151. They are standard L-shaped projections with bicycle handlebar grips 152, 154 that extend inward and down from the lower end portions of both bows 148, 149 on their concave sides.

FIG. 20 shows that the small unit bubble maker 146 of the present invention and frame ring 143 can be stored simply between the circular pallet liner 141 and the rotatable frame ring tee 144 of the upper frame ring 142. This is achieved because the upper ring 142 is slightly larger in diameter than the lower ring 143. Thus, when their tee assemblies 144, 145 are collapsed or rotated inward, both the smaller ring 143 and small unit bubble maker are housed, concentrically, within the outer ring 142 and held by the tees 144 of the outer ring 142 against the overlying pallet liner 141. This arrangement greatly enhances portability and ease of storage.

It will be understood by those skilled in the art that obvious structural modification can be made without departing from the spirit of the invention. For example, though the embodiment of FIGS. 1–17 is shown with welded and detachable pieces, it could be made of custom molded integral parts. Accordingly, reference should be made primarily to the accompanying claims, rather than the foregoing specification, to determine the scope of the invention.

Having thus described the invention, what is claimed is:

1. A bubble maker comprising:

a plurality of elongate, arcuate bow members, each having an upper end, a middle section, and a lower end, each of said members rigid over its length from its upper end to its lower end, the upper end of each of said members pivotally connected to the upper end of each of the other members and the lower end of each of said members pivotally connected to the lower end of each of the other members;

hand grips, each grip connected to a bow member near said member's lower end, whereby the bow members can be pivoted from a closed position generally parallel and in contact with one another over their length to an open position in which said members middle sections are apart from one another and said members enclose an opening of generally lenticular shape for making bubbles.

2. The bubble maker of claim 1 wherein the bow members comprise hollow tubes that contain a fluid supply means for supplying bubble-making fluid to the outside of the tubes, said supply means comprising a plurality of holes spaced along each tube.

3. The bubble maker of claim 1 wherein the number of bow members is two.

4. A bubble maker as claimed in claim 1 further comprising means for fixing each of said hand grips in set apart relation at a fixed distance from the bow member to which it is connected.

5. A bubble maker as claimed in claim 4 in which said fixed distance is not the same for all of said hand grips.

6. A bubble maker as claimed in claim 5 in which said hand grips are bicycle hand grips.

7. A bubble maker as claimed in claim 1 further comprising a joint in the middle section of each bow member to allow said bow member to separate into an upper section and a lower section.

8. A bubble maker as claimed in claim 7 further comprising rigid extension sections which can be inserted between said upper and said lower sections of said bow members to increase the length of said bow members.

9. A bubble maker as claimed in claim 1 wherein each bow member is a hollow tube with a wall and an inner diameter, said bubble maker further comprising a bubble fluid supply system including:

holes in said walls; and a screen mesh sleeve lying within each tube, said screen mesh sleeve having a diameter approximately equal to the inner diameter of said tube.

10. A bubble maker as claimed in claim 9 in which, when said bow members are in the closed position, said holes in the walls of adjacent bow members oppose one another.

11. A bubble maker as claimed in claim 1 in which said upper ends are connected by a first rubber tube and said lower ends are connected by a second rubber tube.

12. A bubble-making system comprising:

a bubble maker, said bubble maker including a plurality of elongate, arcuate bow members, each having an upper end, a middle section, and a lower end, each of said members rigid over its length from its upper end to its lower end, the upper end of each of said members pivotally connected to the upper end of each of the other members and the lower end of each of said members pivotally connected to the lower end of each of the other members;

hand grips, each grip connected to a bow member near said member's lower end, whereby the bow members can be pivoted from a closed position generally parallel and in contact with one another over their length to an open position in which said members middle sections are apart from one another and said members enclose an opening of generally lenticular shape for making bubbles; and a pallet for holding bubble-making fluid, said pallet including an impermeable membrane and a tubular frame with an open support having a top lip portion, said impermeable membrane supported at its perimeter by said lip portion; and a chassis connected to said tubular frame, said chassis having a plurality of support legs extending downwardly therefrom.

13. The bubble making system of claim 5 wherein the top lip portion has a lower end and an upper end said lower end being wider than said upper end.

14. The bubble-making system of claim 12 wherein a plurality of said support legs have attached wheels for selectively rolling the pallet to a desired location.

15. The bubble-making system of claim 5, wherein said top lip portion of said tubular frame has a lower end and an upper end said lower end being wider than said upper end.

16. The bubble-making system of claim 15 wherein a plurality of the chassis' support legs have attached wheels for selectively rolling the pallet to a desired location.

17. A bubble-making system as claimed in claim 15 further comprising clamping means, said membrane is folded over at said lower end to form a pocket which slides over the lower end of said support lip and said narrow end is clamped to said upper end of said support lip by said clamping means.

18. A bubble-making system for holding bubble making fluid as described in claim 12 in which said top lip portion is of circular plan form.

19. The bubble-making system of claim 17 further comprising a drain plug at said lower end of said membrane.

20. A bubble making system as in claim 12 in which said tubular frame is circular with a radius and said arcuate bow members have a radius generally equal to said pallet radius.

* * * * *